US006710234B2

(12) United States Patent
Gregory

(10) Patent No.: US 6,710,234 B2
(45) Date of Patent: Mar. 23, 2004

(54) STRINGED MUSICAL INSTRUMENT INCORPORATING AN ADJUSTABLE STRING TREE

(75) Inventor: Maestro Alex Gregory, 6032 Colfax Ave., North Hollywood, CA (US) 91606

(73) Assignee: Maestro Alex Gregory, North Hollywood, CA (US)

( * ) Notice: Subject to any disclaimer, the term of this patent is extended or adjusted under 35 U.S.C. 154(b) by 0 days.

(21) Appl. No.: 10/328,725

(22) Filed: Dec. 23, 2002

(65) Prior Publication Data

US 2003/0110921 A1 Jun. 19, 2003

Related U.S. Application Data

(63) Continuation of application No. 09/709,165, filed on Nov. 8, 2000, now Pat. No. 6,515,207, which is a continuation-in-part of application No. 29/122,909, filed on May 5, 2000, now Pat. No. Des. 441,006.

(51) Int. Cl.[7] ..... G10D 3/14
(52) U.S. Cl. ..... 84/312 R
(58) Field of Search ..... 84/312 R, 314 N, 84/453, 454, 455, 318

(56) References Cited

U.S. PATENT DOCUMENTS

| | | | | | |
|---|---|---|---|---|---|
| 3,933,703 | A | | 1/1976 | Hutchins | 84/318 |
| 4,104,947 | A | | 8/1978 | Oster | 84/318 |
| 4,324,165 | A | | 4/1982 | Wilkerson | 84/318 |
| 4,823,670 | A | | 4/1989 | Gherman et al. | 84/318 |
| 5,373,770 | A | | 12/1994 | Dudley | 84/318 |
| 5,394,783 | A | * | 3/1995 | Sperzel | 84/297 R |
| 5,481,956 | A | * | 1/1996 | LoJacono et al. | 84/314 N |
| 5,497,690 | A | | 3/1996 | Soupios | 84/453 |
| 5,537,908 | A | * | 7/1996 | Rabe et al. | 84/454 |

* cited by examiner

*Primary Examiner*—Kimberly Lockett
(74) *Attorney, Agent, or Firm*—James R. Brueggemann, Esq; Sheppard, Mullin, Richter & Hampton LLP

(57) ABSTRACT

An adjustable string tree provides selectable adjustment for tension on a stringed musical instrument. A back plate is fixed to a base plate, which in turn is fixed to the musical instrument. A top plate adjustably and slidably engages the back plate in order to exert tension on a string. Adjustment may be provided by an adjustment bolt in opposition to a compression spring. In a preferred embodiment, an indentation is provided in the top plate in alignment with the string to better hold the string in association with the top plate.

10 Claims, 4 Drawing Sheets

FIG. 4.
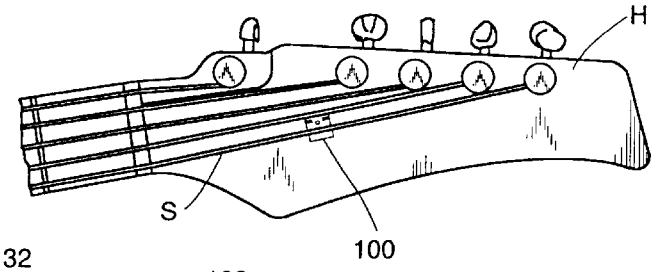
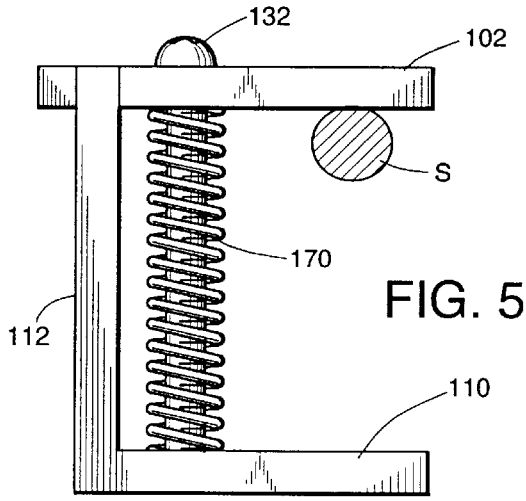
FIG. 5.
FIG. 6.
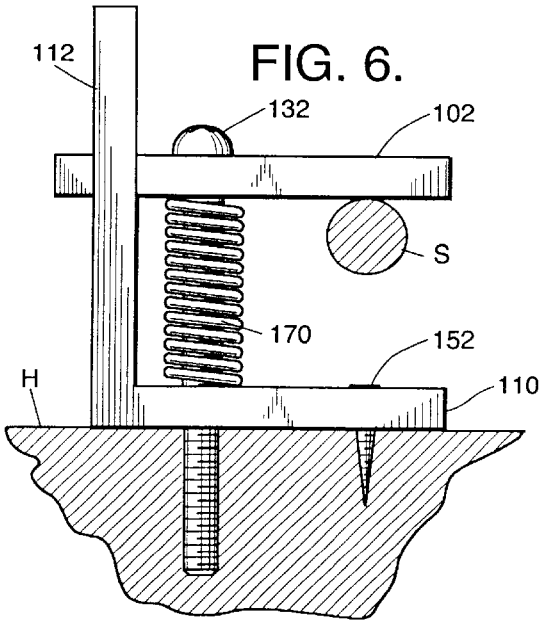
FIG. 7.
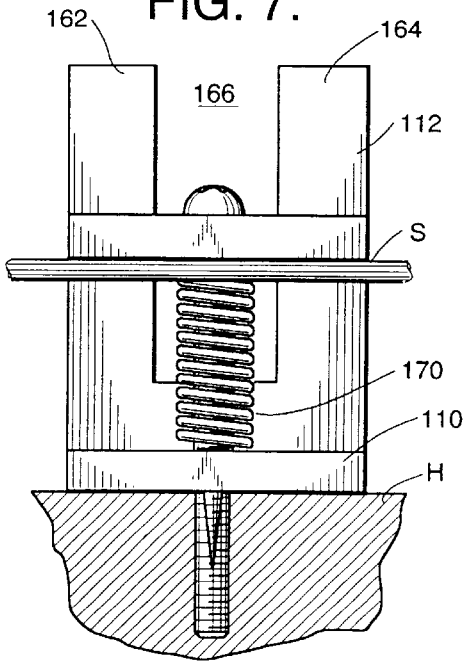

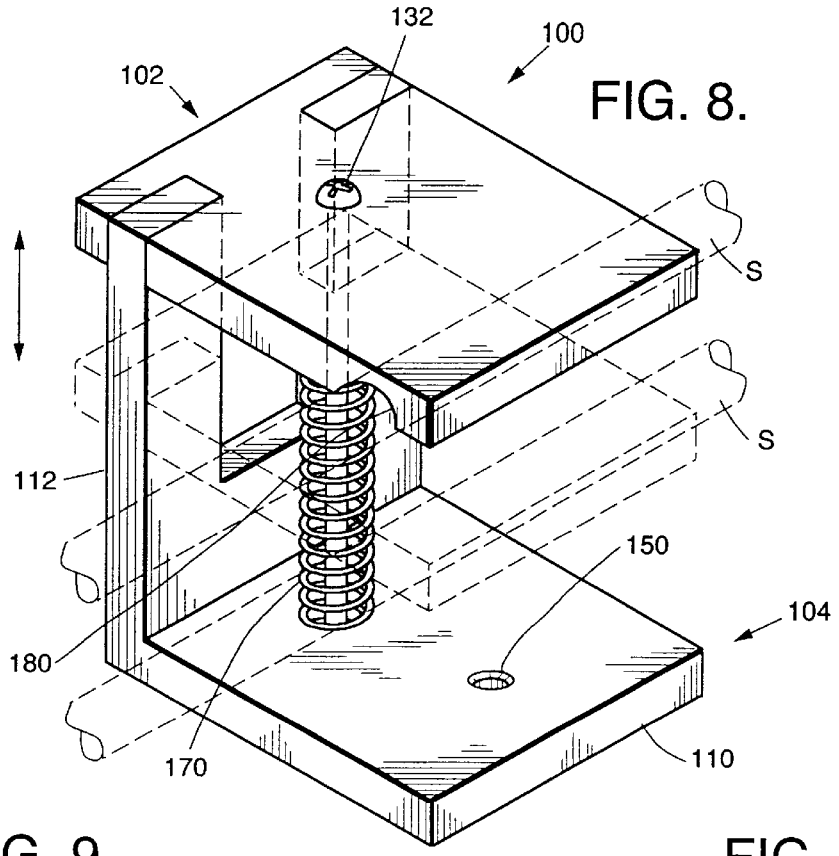
FIG. 8.
FIG. 9.
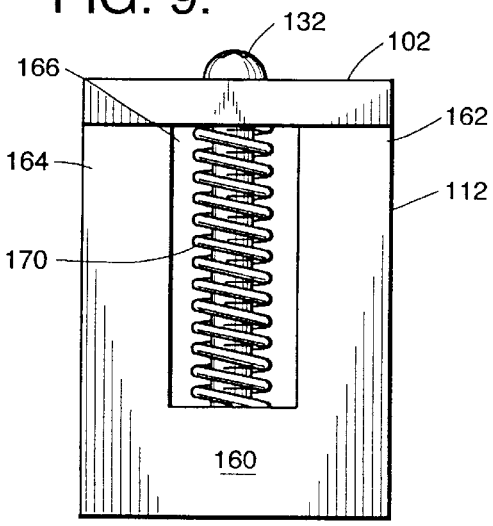
FIG. 10.
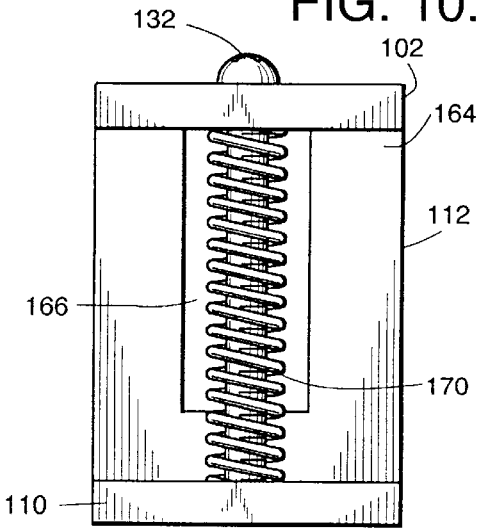

STRINGED MUSICAL INSTRUMENT INCORPORATING AN ADJUSTABLE STRING TREE

CROSS-REFERENCES TO RELATED APPLICATIONS

This is a continuation of U.S. patent application Ser. No. 09/709,165, filed Nov. 8, 2000, now U.S. Pat. No. 6,515,207, which is a continuation-in-part of U.S. patent application Ser. No. 29/122,909, filed May 5, 2000, now U.S. Pat. No. D441,006.

BACKGROUND OF THE INVENTION

1. Field of the Invention

This invention relates to musical instruments and more particularly to accessories for stringed instruments, the present invention being an adjustable string tree.

2. Description of the Related Art

As indicated by the underlying U.S. patent application Ser. No. 09/511,878 filed on Feb. 25, 2000 entitled Improved Stringed Musical Instruments And Method Therefor, string trees, or string retainers, may be used in order to selectively create nodes for vibrating strings as well as controlling the tension on such strings. In that underlying application, static, or non-adjustable, string trees were disclosed and described for use in the musical instruments also described therein. Further development has provided additional advancements in the art, such that string trees may be made adjustable, and not just formed in a static, or non-adjustable manner.

In the prior application, the height of the string tree must be selected in advance in order to properly tension the string, making more complex the proper adjustment of the string by use of the string tree. Not only the height must be considered, but also the positioning of the string tree. Generally, the location of the string tree is chosen first in order to establish a node for the string portions resonating upon the plucking or driving of the string. The appropriate height is then determined in order to conform the string to the proper geometry/path in order to achieve the proper tension.

Due to the lack of adjustability and height, string trees such as those set forth in the underlying application have inherent limitations that are better addressed by an adjustable string tree. Such an adjustable string tree would advantageously operate in conjunction with current musical instruments, such as an electric guitar, without impeding or obstructing musical performance. Such adjustable string trees would advantageously be predictable in nature so as to provide consistent results no matter what type of string was retained by the string tree.

SUMMARY OF THE INVENTION

The present invention provides an adjustable string tree that efficiently uses minimal components in order to provide string retention, tension adjustment, and node establishment.

A unified base plate and back plate member may be affixed to a structure on a stringed instrument, such as the headstock on an electric guitar. A vertically adjustable top or upper plate adjustably slides vertically while being held in place horizontally with respect to the base plate. An adjustment bolt, in conjunction with a compression spring, serves to hold the adjustable top plate in place. The top plate engages the string to be retained and allows the musician or musical technician to adjustably control the tension on a string by moving the top plate vertically, with upwards motion generally releasing tension on a string and downward motion generally increasing tension on a string.

In an alternative embodiment, horizontal adjustment of the adjustable string tree may be achieved by a rail or other similar system that provides selectable adjustment of the placement of the adjustable string tree of the present invention along the path of the string to be retained.

By providing the adjustable string tree of the present invention, string tension may be selectably adjusted and node placement selectably established.

OBJECTS OF THE INVENTION

It is an object of the present invention to provide an adjustable string tree for musical instruments.

It is another object of the present invention to provide adjustable tension for strings in a musical instrument.

It is yet another object of the present invention to provide selectable nodes for musical instruments.

It is yet another object of the present invention to provide selectably adjustable nodes for stringed musical instruments.

It is yet another object of the present invention to provide adjustable string tension for selectable nodes of a stringed musical instrument.

It is yet another object of the present invention to provide a retrofittable means by which selectable nodes may provide adjustable string tension.

These and other objects and advantages of the present invention will be apparent from a review of the following specification and accompanying drawings.

BRIEF DESCRIPTION OF THE DRAWINGS

FIG. 4 shows a top plan view of a headstock of a guitar, such as an electric guitar, with the adjustable string tree of the present invention in place.

FIG. 5 shows a side elevational view of the adjustable string tree as generally indicated in FIG. 2.

FIG. 6 shows a side elevational view of the adjustable string tree as generally shown in FIG. 2 with the upper plate in a position generally corresponding to that shown in phantom in FIG. 2, and structures underlying the adjustable string tree shown in partial cutaway view.

FIG. 7 is a front plan view of the adjustable string tree shown in FIG. 6.

FIG. 8 is an enlarged view of an alternative embodiment of the adjustable string tree as shown in FIG. 2 with the upper plate having a concave indentation to accommodate the string and downward motion of the upper plate shown in phantom, the string engaged by the upper plate shown in phantom in the upper and lower positions.

FIG. 9 is a rear plan view of the adjustable string tree of FIG. 8.

FIG. 10 is a front elevational view of the adjustable string tree of FIG. 8.

DESCRIPTION OF THE PREFERRED EMBODIMENT(S)

The detailed description set forth below in connection with the appended drawings is intended as a description of presently-preferred embodiments of the invention and is not intended to represent the only forms in which the present invention may be constructed and/or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention.

Figure 2:
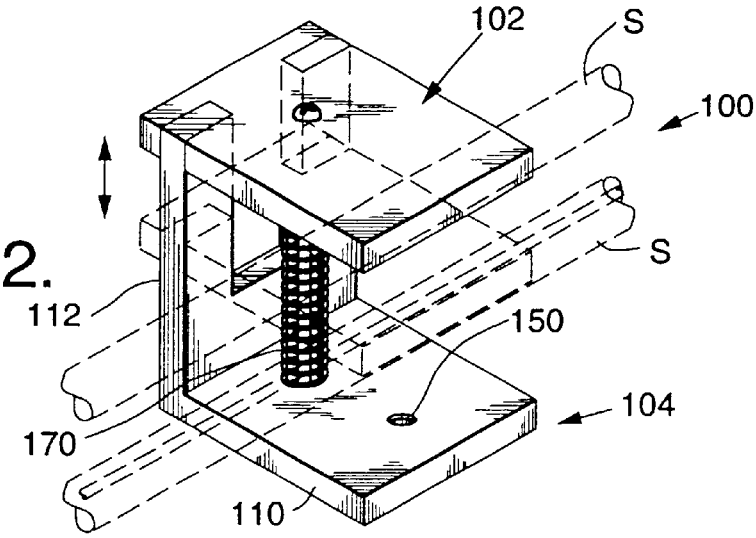
FIG. 2 is a top right perspective view of the adjustable string tree of the present invention showing adjustment of the top plate in phantom in conjunction with a string so adjusted, also in phantom.
Figure 3:
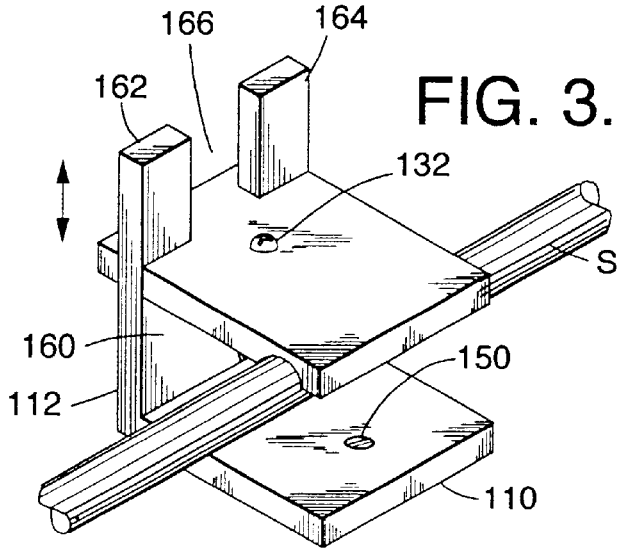
FIG. 3 shows a top right perspective view of an alternative embodiment of the adjustable string tree of the present invention in a position generally corresponding to that of the upper plate as shown in phantom in FIG. 2, the top plate having a groove or indentation to accommodate the string.
Figure 11:
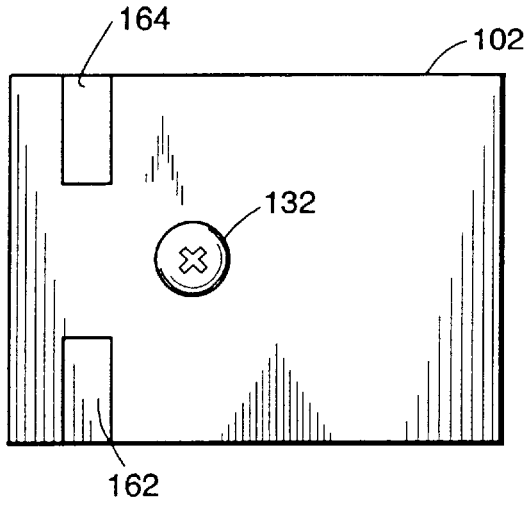
FIG. 11 is a top plan view of the adjustable string tree shown in FIG. 8.
Figure 12:
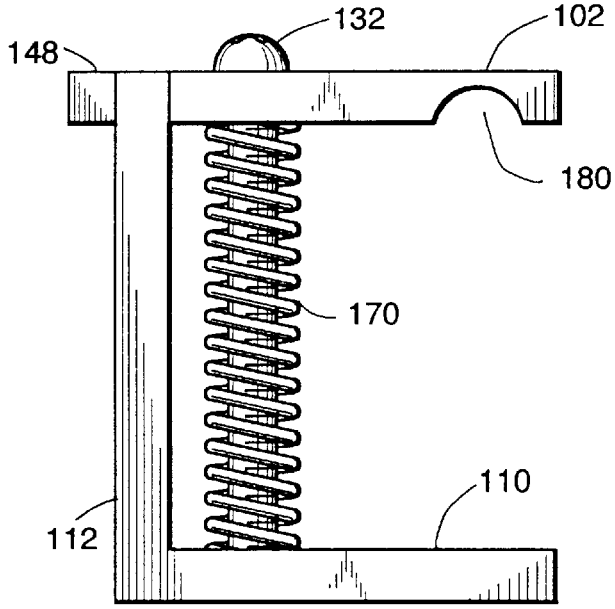
FIG. 12 is a right side plan view of the adjustable string tree as shown in FIG. 8, with the left side being a mirror image thereof.

As shown in FIGS. 2 and 8, the adjustable string tree 100 of the present invention has a top plate 102 and a unified base plate/back plate structure 104.

The top plate 102 slidably engages the integrated base plate/back plate structure 104 in order to adjustably provide vertical positioning and tension upon a string S. The integrated base plate/back plate structure 104 is attached to a headstock H as shown in FIG. 4 as for an electric, acoustic, or other guitar or other stringed instrument.

Figure 1:
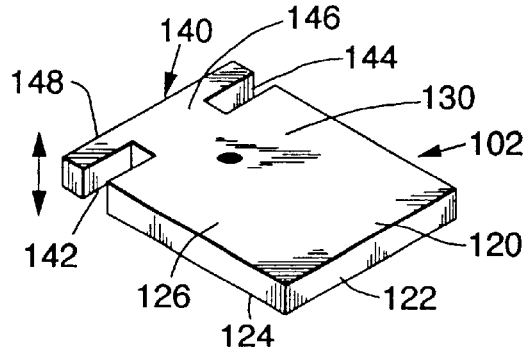
FIG. 1 is a top right perspective view of a top plate used in the present invention.

As shown in FIG. 1, the top plate 102 has a front plate 120 that engages a string S at its distal end 122. Generally, such engagement of a string S is on the underside 124 of the front plate 120. A hole or aperture 130 may be present in the top plate 102 in order to provide for threadable adjustment to the top plate 102. Threadable adjustment of the top plate 102 may be achieved in two ways, with the adjustment bolt or screw 132 threading into the base plate 110 and taking the top plate 102 with it or, alternatively, the threaded adjustment bolt 132 threadably engaging the top plate 102 and controlling the disposition of the top plate 102 relative to the base plate 110. For the latter case, the adjustment bolt 132 would not screw into the base plate 110, but would turn upon the base plate 110. The threaded engagement between the adjustment bolt 132 and the top plate 102 then causes the top plate 102 to move with respect to the base plate 110 as the top plate 102 slides with respect to the back plate 112.

As shown in FIG. 1, a T-shaped section 140 projects rearwardly from the front plate 120 and defines two mortises 142, 144 oppositely opposed on either side of a tenon 146 forming the upright portion of the T in the T-shaped section 140. The top portion 148 of the T-shaped section generally matches that of the front plate 120 of the top plate 102. The top portion 148 of the T-shaped section 140 is separated at its lateral ends by the mortises 142, 144 from the front plate portion 120 of the top plate 102.

As shown in FIG. 2, the integrated base plate/back plate structure 104 has a base plate 110 fixed at generally a right angle to the back plate 112. As for the top plate 102, the base plate 110 and back plate 112 are generally formed of strong metal such as steel or the like, including carbon steel, which may be powder coated or otherwise for a more pleasing appearance. Alternatively, softer metals may allow for additional cosmetic enhancements and, depending on the required stress tolerances and operating conditions, may provide adequate support for the adjustable string tree 100 of the present invention.

As shown in FIG. 2, the base plate 110 may have a hole 150 through which a screw may fit in order to attach the base plate to a headstock H (FIG. 4) or other portion of a musical instrument. Alternative means other than screws might be used in order to fix the base plate 110 to the musical instrument.

FIGS. 6 and 7 show one embodiment of the present invention showing a screw 152 descending into a portion of the instrument to engage the instrument and hold the base plate 110 firmly in place. A screw hole 150 may be generally centrally located along the base plate 110 in a forward section thereof. In one embodiment, the screw hole 150 may be generally below a preferred area of the front plate 120 used to engage the string S. Under such circumstances, the string S would then be generally over the screw 152 and screw hole 150.

Figure 13:
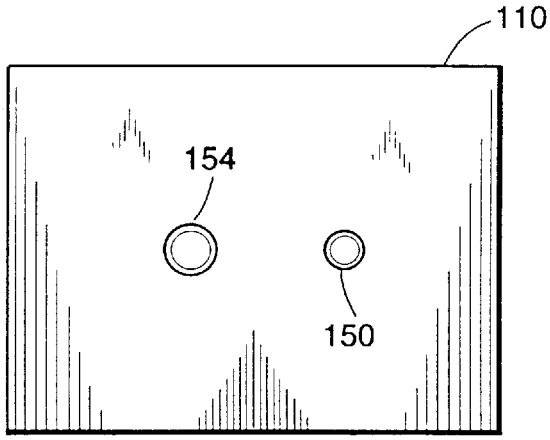
FIG. 13 is a bottom plan view of the adjustable string tree of FIG. 8.

The base plate 110 has a second bolt hole 154 (FIG. 13) generally in alignment with the top plate aperture 130. In being so aligned with the top plate aperture 130, the bolt hole 154 of the base plate 110 allows for the use of an adjustment bolt 132 to pass through both the top plate 102 and the base plate 110. As shown in FIGS. 6 and 7, in one embodiment, the bolt hole 154 may allow the passage of the adjustment bolt 132 through the base plate 110. In other embodiments, the bolt hole 154 may serve as a means by which the turning end of the adjustment bolt 132 may be allowed to articulate rotationally in a fixed position. This would then allow an adjustment bolt 132 in threaded engagement with the top plate 102 to vertically adjust the top plate 102 and the tension exerted against a string S. Under such conditions, the adjustment bolt 132 would not descend with the top plate 102.

The back plate 112 generally has a lower upright supporting section 160 from which two vertical posts or tenons 162, 164 extend upwardly and away from the lower upright supporting section 160. Defined between the two tenons 162, 164 is a mortise or gap 166 into which the tenon 146 of the T-shaped section 140 slidably fits.

The configuration between the mortise and tenons present in the top plate 102 and the back plate 112 provide reliable means by which the top plate 102 may slidably and adjustably engage the back plate 112. This slidable engagement is achieved by the use of complementing mortise and tenon sets, one set disposed vertically and one set disposed horizontally. This fixes the top plate 102 in position with respect to the back plate 112 as well as the base plate 110.

The horizontal mortise and tenon set may generally be considered that to be of the tenon 146 of the T-shaped section 140 in conjunction with the mortises 142, 144 present in the top plate 102. The back plate 112 provides a vertical mortise and tenon set with the vertical tenons 162, 164 on either side of the vertical mortise 166. These mortise and tenon sets, coupled with the top portion of the T-shaped section 140 as well as the front plate 120 of the top plate 102, serve to prevent horizontal movement of the top plate 102 with respect to the back plate 112 and the integrated plate structure 104.

The top plate tenon 146 slidably travels through the back plate mortise 166 in order to provide vertical adjustment to the top plate 102. The vertical tenons 162, 164 travel through the horizontal mortises 142, 144 of the top plate 102. Motion of the top plate 102 is restrained by the adjustable bolt in conjunction with the compression spring 170.

The compression spring 170 provides an upward bias to the top plate 102. The upward travel of the top plate 102, as urged by the compression spring 170, is obstructed by the head or other part of the adjustment bolt 132. By the use of the opposing tensions between the upwardly biasing compression spring 170 and the downwardly restraining adjustment bolt 132, the top plate 102 is generally held in place with respect to the top plate 102. This stable structure is enhanced by the upward urging of a string S under tension by the top plate 102.

As shown in FIGS. 5, 3, 8 and 12, an alternative embodiment of the present invention provides an indentation 180 into which the string S may fit and be positively retained by the top plate 102. The indentation 180 serves to better retain the string S in association with the top plate 102. This allows the string S to undergo more activity, such as vibration, while still being retained by the top plate 102. It also prevents the string as from disengaging the top plate 102 and becoming free from the retention of the adjustable string tree 100. In an alternative embodiment, a protrusion, or ridge (not shown), may also be used to engage the string S.

In an alternative embodiment not shown in the drawings, a rail or other structure may provide a framework by which the adjustable string tree 100 of the present invention may engage the headstock H or other portion of a musical instrument adjacent musical strings. This would provide for the lateral or horizontal movement of the adjustable string tree in a selectable manner such that the placement of the node created by the adjustable string tree may be also adjusted. Such a framework would be in a path generally the same as that taken by a string to be engaged by the adjustable string tree. A selectable and adjustable locking mechanism may serve to hold the adjustable string tree in place upon the selection of a node position. The adjustable string tree could then be used to vertically adjust the top plate 102 and the corresponding tension on the adjacent string S.

While the present invention has been described with regards to particular embodiments, it is recognized that additional variations of the present invention may be devised without departing from the inventive concept.

What is claimed is:

1. A stringed musical instrument comprising:

a body having an elongated neck, a headstock located at one end of the neck, and a transverse nut separating the neck from the headstock;

a string tension adjustment device located on the headstock;

a string extending along the neck and across the nut, wherein one end of the string attaches to the string tension adjustment device; and a string tree including a base attached to the headstock, at a location between the nut and the string tension adjustment device, a top plate coupled to the base and having a surface that engages the string, and a height adjustment device configured to controllably adjust the position on the top plate relative to the base, thereby correspondingly adjusting the distance between the string and the headstock.

2. The stringed musical instrument as set forth in claim 1, wherein:

the height adjustment device includes an adjustment bolt coupled to the top plate and the base, the adjustment bolt limiting travel of the top plate, and a compression spring acting cooperatively with the adjustment bolt, by urging the top plate away from the base; and the top plate is selectably and adjustably disposed with respect to the base by means of the adjustment bolt, and the top plate is held against the adjustment bolt by the compression spring.

3. The stringed musical instrument as set forth in claim 1, wherein the base comprises:

a base plate attached to the headstock; and a back plate coupled to the base plate, and projecting away from the base plate.

4. The stringed musical instrument as set forth in claim 3, wherein the back plate comprises first and second vertical tenons projecting away from the base plate, thereby defining a vertical mortise.

5. The stringed musical instrument as set forth in claim 1, wherein:

the top plate comprises a T-shaped section disposed proximate the back plate, the T-shaped section determining first and second horizontal mortises, and further defining a first horizontal tenon;

the first and second vertical tenons of the back plate slidably fit into the first and second horizontal mortises of the top plate; and the first horizontal tenon of the top plate slidably fits into the vertical mortise of the back plate;

whereby the top plate slidably and stably engages the back plate.

6. The stringed musical instrument as set forth in claim 5, wherein the top plate defines an indentation for receiving the string.

7. The stringed musical instrument as set forth in claim 5, wherein the top plate includes a protrusion for engaging the string.

8. A stringed musical instrument comprising:

a body having an elongated neck, a headstock located at one end of the neck, and a transverse nut separating the neck from the headstock;

an string tension adjustment device located on the headstock;

a string extending along the neck and across the nut, wherein one end of the string attaches to the string tension adjustment device; and a string tree including a base plate attached to the headstock at a location between the nut and the string tension adjustment device, a back plate coupled to the base plate, comprising first and second vertical tenons projecting away from the base plate, and thereby defining a vertical mortise, a top plate coupled to the base plate and having a surface for engaging a string, the top plate having a T-shaped section disposed proximate the back plate, thereby defining first and second horizontal mortises, and further defining a first horizontal tenon, wherein the first and second vertical tenons of the back plate slidably fit into the first and second horizontal mortises of the top plate, and the first horizontal tenon of the top plate slidably fits into the vertical mortise of the back plate, an adjustment bolt coupled to the top plate and the base plate, for controllably adjusting the position of the top plate relative to the base plate and thereby adjusting the distance between the string and the headstock, and a compression spring acting cooperatively with the adjustment bolt, by urging the top plate away from the base plate and holding the top plate against the adjustment bolt.

9. The stringed musical instrument as set forth in claim 8, wherein the top plate defines an indentation for receiving the string.

10. The stringed musical instrument as set forth in claim 8, wherein the top plate includes a protrusion for engaging the string.

* * * * *